United States Patent [19]

Cheek

[11] 4,196,781

[45] Apr. 8, 1980

[54] TELESCOPING JOINT

[76] Inventor: Alton E. Cheek, 1949 Vuelta Grande Ave., Long Beach, Calif. 90815

[21] Appl. No.: 931,853

[22] Filed: Aug. 9, 1978

[51] Int. Cl.[2] ..... E21B 7/04

[52] U.S. Cl. ..... 175/61; 175/45; 175/321

[58] Field of Search ..... 175/61, 321, 45, 104; 166/65 R, 66; 64/23

[56] References Cited

U.S. PATENT DOCUMENTS

| | | | |
|---|---|---|---|
| 1,971,922 | 8/1934 | Smith | 175/321 |
| 2,007,666 | 9/1935 | Smith | 175/321 |
| 3,255,612 | 6/1966 | Mayer et al. | 175/321 |
| 3,722,605 | 3/1973 | Isham | 175/61 |

*Primary Examiner*—William F. Pate, III

*Attorney, Agent, or Firm*—Albert L. Gabriel

[57] ABSTRACT

An axially extensible telescoping joint is employed in a directional drilling string to reduce the number of times for a given footage of well drilled that the wireline from the downhole survey or steering tool to the surface readout must be tripped through the string for adding more drill pipe. By drilling the first half of a drilling sequence with the telescoping joint collapsed, and then the second half of the sequence with the telescoping joint extended, twice the conventional footage can be drilled between wireline trips, and two stands of drill pipe can be added rather than the conventional single stand each time the wireline is tripped.

13 Claims, 6 Drawing Figures

FIG. 1
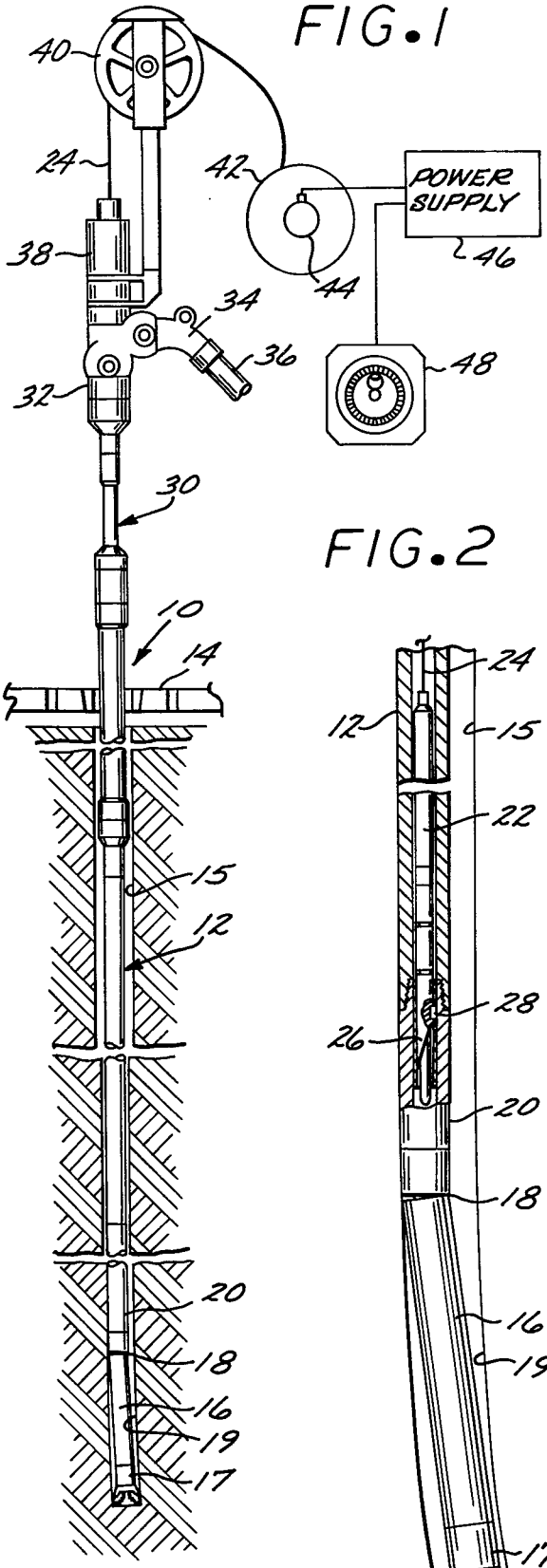
FIG. 2
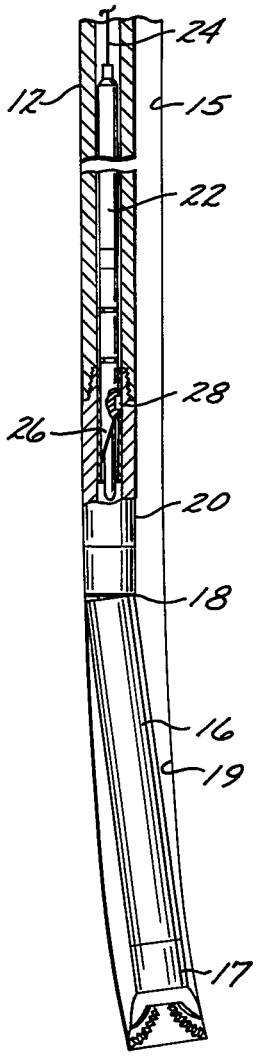
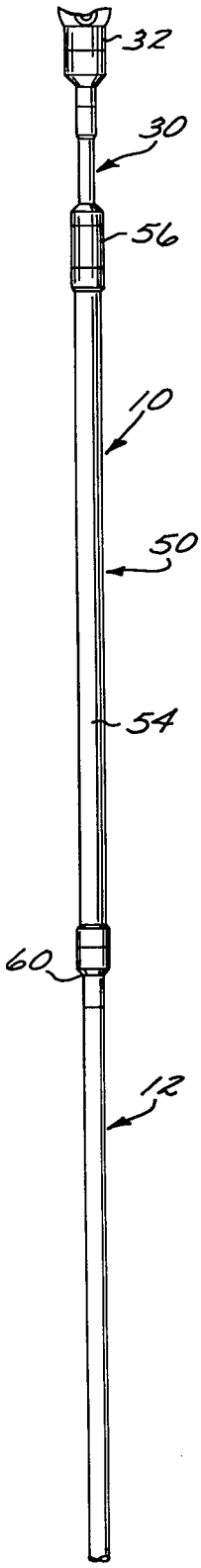
FIG. 3
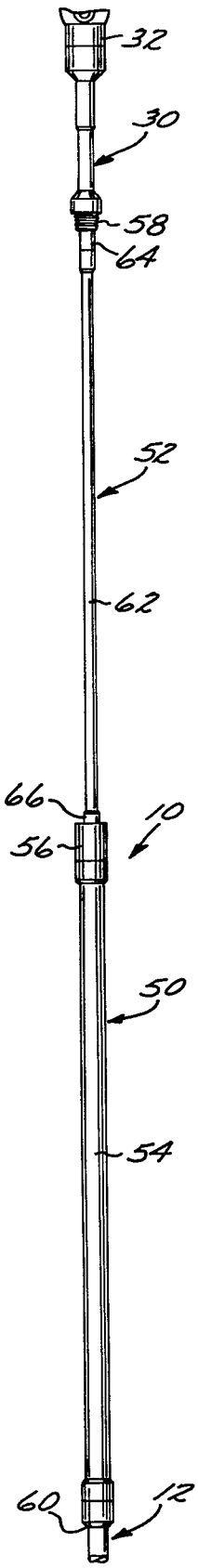
FIG. 4

TELESCOPING JOINT

BACKGROUND OF THE INVENTION

1. Field of the Invention

The invention relates to drill strings having a wireline extending down therethrough from surface readout means to a downhole probe such as a survey or steering tool employed to sense azimuth and drift angle during directional drilling.

2. Description of the Prior Art

Directional drilling is widely utilized today for the efficient exploitation of oil fields, but requires great accuracy in drill orientation as to both azimuth and inclination or drift angle.

Straight sections of the bore are drilled with a simple rotary drill, and required alterations in the direction of the bore are achieved using a downhole mud motor drill of either the positive displacement or turbine type which is offset at a small angle relative to the drill string axis by means of a bent sub. The bent sub causes the drill to follow a path which curves away from the straight section of the bore above it, and steering is accomplished by rotation of the drill pipe at the surface to the desired azimuthal orientation of the bent section. The amount of deflection or inclination from the straight section of bore above is determined by the length of the curved path that is followed by the drill at the desired azimuth.

A requirement of directional drilling is that the azimuth and inclination angles of the drill be monitored at the surface. Originally, the only type of instruments available for such purpose were pivoted and liquid damped compasses which aligned themselves with the earth's magnetic and gravitational fields. The readings of such downhole instruments had to be recorded by means of a photograph, and such instruments were not adaptable to remote reading because of the difficulties of incorporating an electrical transducer without introducing an error-producing torque onto the delicate pivoted elements. Thus, each reading of the instrument required retrieval of the measuring instrument at the surface which was time-consuming and expensive, and even then only static tool orientations could be read. At considerable depths, as for example depths in excess of about 10,000 feet, it is extremely difficult to accurately steer the drill because reaction torque twists the drill pipe to some indeterminate wind-up angle, and therefore accurate direction drilling at depth requires continuous surface monitoring of the drill orientation.

A downhole survey or steering tool capable of providing a continuous surface readout through a wireline data transmitting conductor was developed in the late 1960's by Russell Attitude Systems of Cheltenham, England, and several survey or steering tools of this type are currently being marketed in the United States, as for example by Sperry-Sun and by Eastman Whipstock, both of Houston, Tex.

While such survey or steering tools have solved the problem of constant monitoring of both azimuth and inclination angle at the surface during directional drilling, they still have the disadvantage that each time a stand of drill pipe is added to the drill string during directional drilling, the survey or steering tool and its wireline must be tripped up out of the drill string before the additional stand of drill pipe is added to the string, and then the survey or steering tool and wireline must be tripped back down through the drill string and the survey or steering tool reengaged in its properly oriented, operative position associated with the drill.

Such trips of the survey or steering tool and wireline are costly and time-consuming. Thus, wireline companies currently charge from 20¢ to 35¢ per foot of bore depth for each round trip of the wireline, plus hourly rates for the truck, an operator, and a helper. Tripping of the wireline out of and back into the drill string at a depth of about 5,000 feet requires approximately 2½ to 3 hours. An additional expense is a current charge of $500 per day by each of the companies which now provide such survey or steering tools and associated surface readout equipment, this charge including two operators plus tools. A still further charge is made by the directional drilling company, such companies currently charging an average of $400 per day for operator plus tools. Thus, in addition to the direct per foot trip cost made by the wireline company, each time the survey or steering tool and wireline are tripped there are large additional costs incurred to the wireline company, the company providing the survey or steering tool and associated surface readout equipment, and the directional drilling company, in proportion to the required trip time.

SUMMARY OF THE INVENTION

It is a general object of the present invention to reduce the number of wireline trips that are required during directional drilling, and thereby reduce the associated costs and time lost.

Another object of the invention is to provide a novel apparatus and method which enables twice the footage to be drilled between trips of the survey or steering tool and wireline during directional drilling than is possible with currently used apparatus and methods.

A further object of the invention is to enable two full stands of drill pipe, instead of the conventional one stand of drill pipe, to be added to the drill string each time the survey or steering tool and wireline are tripped out of the drill string during directional drilling. Thus, for the usual 90 foot stands of drill pipe, a full 180 feet of drill pipe can be added to the string for each trip of the survey or steering tool and wireline out of the string with the present invention, instead of the conventional 90 feet of drill pipe permitted by prior art apparatus and methods.

Yet a further object of the invention is to provide apparatus of the character described which is simple in construction and operation, is inexpensive, and may be operated at the wellhead utilizing conventional drill string handling equipment such as a rotary table, slips, tongs and elevator.

An additional object is to provide apparatus of the character described which avoids the necessity for expensive and sometimes troublesome splines, packing and the like.

According to the invention a telescoping joint is connected between the top of the drill string and the swivel and gooseneck for the kelly hose and wireline packoff unit thereabove. This telescoping joint is selectively adjustable between a short or collapsed operative condition and a long or extended operative condition, the amount of extension of the telescoping joint from its collapsed condition to its extended condition corresponding to one stand of drill pipe which may be either 30 feet or 60 feet or 90 feet long according to the height of the derrick and the length of the kelly hose. When the entire drilling assembly has been made up, with the survey or steering tool downhole in association with the mud motor drill, drilling is carried out to a footage corresponding to one stand of drill pipe with the telescoping joint of the invention in its short or collapsed condition; and then the telescoping joint is adjusted to its long or extended condition and additional footage is drilled corresponding to a second stand of drill pipe. Then, the wireline is tripped to retrieve the survey or steering tool into the telescoping joint of the invention, the telescoping joint is collapsed back down to its short condition and backed off from the upper end of the drill pipe, two stands of drill pipe are added to the string and the telescoping joint of the invention reconnected to the string at the top of the newly added drill pipe, and the survey or steering tool and wireline are tripped back down through the string to the operative position of the survey or steering tool, and the apparatus is again ready for another drilling sequence of twice the conventional footage.

The telescoping joint of the present invention has inner and outer telescoping structures which are secured to each other in each of the collapsed and extended operative conditions by threaded tool joint means which is straightforward and economical, is engageable and disengageable by conventional tong means, and avoids the need for expensive and complex splines, packing or the like. The collapsed connection is made by means of right-hand tool joint means, while the extended connection is made by means of left-hand tool joint means.

BRIEF DESCRIPTION OF THE DRAWINGS

These and other objects of the invention will become more apparent in view of the following description taken in conjunction with the drawings wherein:

FIG. 1 is a side elevational view with portions broken away, and having portions thereof shown both diagrammatically and in vertical section, illustrating directional drilling apparatus embodying the present telescoping joint;

FIG. 2 is an enlarged fragmentary side elevational view, partly in vertical section, illustrating downhole directional drilling apparatus with which the telescoping joint of the present invention is shown associated in FIG. 1;

FIG. 3 is a fragmentary elevational view illustrating the telescoping joint of the present invention connected in the drilling apparatus of FIG. 1 and in its short or collapsed condition;

FIG. 4 is a view similar to FIG. 3 but with the telescoping joint of the invention in its long or extended condition;

DETAILED DESCRIPTION

Figure 5:
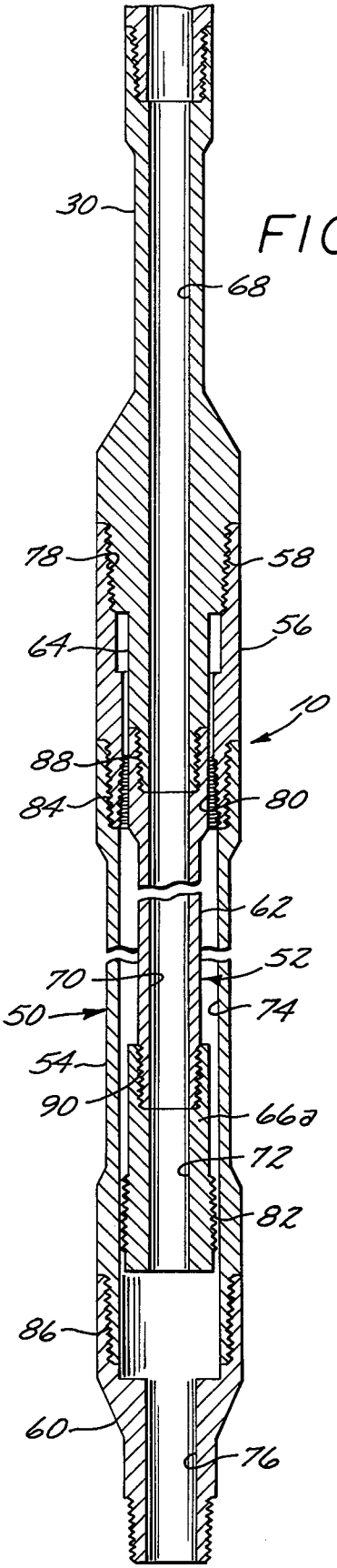
FIG. 5 is an axial section, with portions broken away, illustrating internal details of construction of the invention with the telescoping joint in its short or collapsed condition.

FIGS. 1 and 2 of the drawings illustrate a telescoping joint 10 of the present invention operatively connected to the upper end of a drill string 12 for the purpose of reducing the number of wire line and survey tool trips required during directional drilling. The telescoping joint 10 extends down through rotary table 14 and into well bore 15, the drill string 12 terminating at its lower end in a mud motor drill 16 having a rotating bit sub 17. The mud motor drill 16 may be of either the positive displacement or turbine type and is hydraulically driven by mud that is pumped down through the drill string 12. Mud motor drill 16 is deflected at a small angle relative to the axis of the drill string above it by means of a bent sub 18, which causes the drill 16 to follow a curved path indicated by the curved portion 19 of well bore 15.

Immediately above the bent sub 18 is a muleshoe orienting sub 20 which is fixed relative to bent sub 18 and may be considered as a part of bent sub 18. A survey or steering tool 22 is lowered through the drill string 12 on wire line data transmitting conductor 24, the survey tool 22 having muleshoe 26 on its lower end which correctly rotationally orients survey tool 22 relative to the direction of deflection of mud motor drill 16 when the survey tool 22 is lowered into its operative position as illustrated in FIG. 2. The survey tool 22 is anchored in this correctly oriented position relative to drill 16 by engagement of its muleshoe key 28 in a keyway within the muleshoe orienting sub 20.

Survey or steering tool 22 is adapted to continually sense both azimuthal direction and deflection or drift angle of the drill 16, even during the actual drilling operation, and to continually transmit electrical data signals through wireline 24 to surface readout means. The survey or steering tool 22 may be any one of several such tools which are currently being marketed, as for example the "Magnetic Steering Tool" or "Survey Steering Tool" provided by Sperry-Sun of Houston, Tex., and the "Directional Orientation Tool" provided by Eastman Whipstock, also of Houston, Tex.

Engaged to the upper end of the telescoping joint 10 of the invention is an elevator space sub 30, and above elevator space sub 30 is swivel 32 having gooseneck 34 to which kelly hose 36 is connected for providing the hydraulic fluid or mud to the drill string for driving mud motor drill 16 and washing the drill cuttings up out of the well bore 15. Above swivel 32 is wireline packoff 38 through which the wireline 24 passes, wireline 24 then extending over sheave 40 onto wireline drum 42. The electrical data signals that are transmitted from survey tool 22 through wireline 24 are conducted from a slipring 44 on drum 42 and are processed through power supply 46 to surface readout 48 which displays both azimuth and deflection or drift angle of the drill 16.

FIGS. 3 and 4 of the drawings broadly illustrate the manner in which the telescoping joint 10 of the invention enables twice as much footage of the curved portion 19 of well bore 15 to be drilled between trips of the wireline 24 and survey tool 22 out of the well for adding additional drill pipe to the string 12. When the drill string has been completely made up, and the survey tool 22 is operationally disposed as illustrated in FIG. 2, a drilling sequence is commenced with the telescoping joint 10 of the invention in its short or collapsed condition, which is the condition illustrated in FIG. 3. The drilling sequence commences with the entire telescoping joint 10 above ground in the derrick. The overall length of the telescoping joint 10 in its short or collapsed condition of FIG. 3 is just a little greater than the length of a single stand of drill pipe. Most rigs currently have 136 foot high derricks, so they can handle stands of drill pipe which each consist of three joints of 30 foot drill pipe. Accordingly, for most rigs, the telescoping joint 10 of the present invention in its short or collapsed condition will be a little longer than a 90 foot stand or drill pipe. However, in some instances it will be desirable to employ the invention in connection with 30 foot or 60 foot stands of drill pipe, and in these respective situations the telescoping joint 10 in its short or collapsed condition will be a little longer than 30 feet or a little longer than 60 feet, respectively.

The telescoping joint 10 includes an outer telescoping tubular structure 50 and an inner telescoping tubular structure 52. The principal part of the length of outer telescoping structure 50 is provided by an outer telescoping tube 54 which has a drive bushing 56 at its upper end that serves as an upper end sub. The elevator space sub 30 has thereon an external, downwardly facing tool joint 58 seen in FIG. 4 which is releasably engageable with a complementary internal, upwardly opening tool joint in drive bushing 56 in the short or collapsed condition of the tool. A crossover sub 60 at the lower end of outer telescoping tube 54 is adapted to connect the telescoping joint 10 to the upper end of the drill string 12.

With the telescoping joint 10 in its short or collapsed condition of FIG. 3, and the telescoping joint 10 above ground, a drilling sequence is commenced and carried on for a depth of approximately one stand of drill pipe, usually approximately 90 feet, and then when the upper end of the outer telescoping tube 54 gets down to the rotary table 14, a set of slips is put on the outer tube 54 and the tool joint 58 on elevator space sub 30 is disengaged by suitable tongs (not shown) from drive bushing 56. The elevators of the derrick (not shown) are engaged with the elevator space sub 30 and the latter together with the inner telescoping structure 52 of the telescoping joint 10 is raised to extend the tool 10 a length corresponding to an additional stand of drill pipe, as for example an additional 90 feet, to the long or extended condition of the tool 10 as illustrated in FIG. 4. The principal part of the length of inner telescopong structure 52 is provided by an inner telescoping tube 62 which is connected at its top to a reduced neck 64 on elevator space sub 30 below tool joint 58. A tubular connector 66 is mounted on the lower end of the inner telescoping tube 62, and in the short or collapsed condition of the tool 10 this tubular connector 66 is free within the lower end of outer telescoping tube 54. This tubular connector 66 is freely axially slidable up through the outer telescoping tube 54 when the tool 10 is extended to its long condition of FIG. 4, the tubular connector 66 having thereon an external, upwardly facing left-hand tool joint which is releasably engageable in a complementary internal, downwardly opening left-hand tool joint in the drive bushing 56 to secure the telescoping joint 10 in its long or extended condition of FIG. 4. This releasable engagement of tubular connector 66 in drive bushing 56 may be effected by suitable tongs (not shown).

If the wireline 24 is pulled up during this extension of the telescoping joint 10, it is then lowered again so that survey tool 22 is operatively positioned as in FIG. 2 before the drilling sequence is continued. Then, drilling is carried for a distance of another stand of drill pipe, as for example another 90 feet, before it is necessary to pull the drill string 12, and hence necessary to trip the wireline 24 and survey tool 22 out of the drill string. Thus, the telescoping joint 10 of the invention enables each drilling sequence between required trips of the survey tool 22 and wireline 24 out of and back into the drill string 12 to be for a depth of two full stands of drill pipe, i.e., a depth of 180 feet where the typical 90-foot stands of drill pipe are employed.

A more complete operational sequence involving the use of the telescoping joint tool 10 of the present invention will be described hereinafter in detail.

Figure 6:
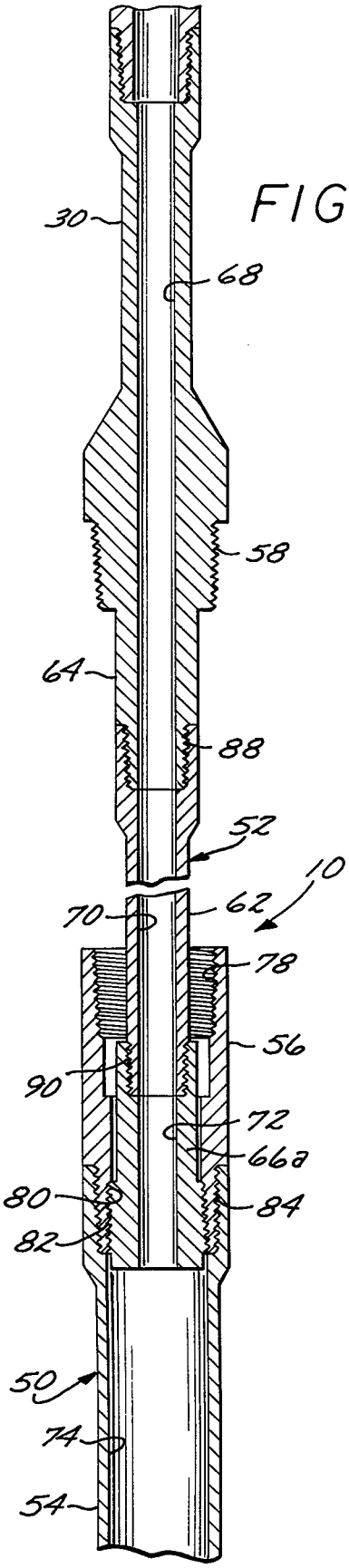
FIG. 6 is an axial section with a portion broken away similar to FIG. 5, but showing the telescoping joint of the invention in its long or extended condition.

FIGS. 5 and 6 illustrate internal details of construction of the telescoping joint 10, the telescoping joint 10 being shown in FIG. 5 in its short or collapsed condition of FIG. 3, and being shown in FIG. 6 in its long or extended condition of FIG. 4.

The telescoping joint 10 as illustrated in FIGS. 5 and 6 is slightly modified from the joint 10 as illustrated in FIG. 4, but this does not alter the operation of the tool. Thus, for illustrative purposes, in FIG. 4 a portion of the tubular connector 66 is shown projecting upwardly beyond the drive bushing 56, and if such construction is employed then when the left-hand tool joints of drive bushing 56 and tubular connector 66 are being either connected together or disconnected, then tongs may be engaged with the drive bushing 56 on the one hand and tubular connector 66 on the other hand. However, in FIGS. 5 and 6, the tubular connector, designated *66a* because of the difference, does not project upwardly beyond the upper end of drive bushing 56 in the long or extended condition of the tool 10 as seen in FIG. 6, and in such case when the connection between the left-hand tool joints of drive bushing 56 and tubular connector *66a* is made or unmade, the tongs may be engaged with the inner telescoping tube 62 just above the drive bushing 56 instead of with the tubular connector *66a*.

Axial passage means extend through the entire vertical length of the telescoping joint tool 10 so as to enable survey tool 22 and wireline 24 to be tripped through the telescoping joint tool 10, and to allow drilling mud to be flowed through the tool 10. This axial passage consists of the following series of coaxial passages: passage 68 through elevator space sub 30, passage 70 through inner telescoping tube 62, passage 72 through connector *66a*, passage 74 through outer telescoping tube 54, and passage 76 through crossover sub 60.

FIGS. 5 and 6 illustrate the various tool joints and tool joint connections which are employed in making up and operating the telescoping joint 10, and all of these may be right-hand threaded tool joints except for the two which are releasably engageable between the drive bushing 56 and tubular connector *66a*.

The tool joints which are releasably engageable to permit operation of the telescoping joint 10 between its short or collapsed condition of FIG. 5 and its long or extended condition of FIG. 6 are the following: the external, downwardly facing tool joint 58 previously described on space sub 30 is adapted to be releasably coupled with an internal, upwardly opening tool joint 78 in drive bushing 56, the tool joints 58 and 78 being made up or coupled in the short or collapsed condition of the tool as shown in FIG. 5 and being uncoupled and axially spaced apart in the long or extended condition of the tool as illustrated in FIG. 6. The drive bushing 56 also has an internal, downwardly opening tool joint 80 which is a left-hand tool joint; i.e., it has left-hand threads. An external, upwardly facing left-hand tool joint 82 is disposed on connector *66a*, and is adapted to be releasably coupled with the left-hand tool joint 80 in drive bushing 56. In the short or collapsed condition of tool 10 as shown in FIG. 5, these left-hand tool joints 80 and 82 are disengaged from each other and axially spaced apart, the enlarged lower end portion of tubular connector *66a* bearing tool joint 82 being smaller than the inside diameter of outer telescoping tube 54 and freely axially slidable therein. When the inner telescoping structure 52 is pulled out to the long or extended condition of the tool as shown in FIG. 6, it is secured in this long or extended condition by making up the connection between the left-hand tool joints 80 and 82 on drive bushing 56 and tubular connector 66*a*, respectively. It is to be noted that since the tubular connector 66*a* threads upwardly into the bottom of drive bushing 56, the left-hand threaded tool joints 80 and 82 permit the inner telescoping tube 62 and tubular connector 66*a* to be torqued clockwise relative to the drive bushing 56 when the tool joints 80 and 82 are being engaged or made up, looking down on the tool and rotary table.

When the telescoping joint tool 10 is initially made up, the remaining tool joint connections therein are torqued up sufficiently tightly so as to remain fixed or permanent during the normal operation of the tool 10 between its short or collapsed condition of FIG. 5 and its long or extended condition of FIG. 6. Such fixed tool joint connections are a connection 84 between the lower end of drive bushing 56 and the upper end of outer telescoping tube 54; a connection 86 between the lower end of outer telescoping tube 54 and the upper end of crossover sub 60; a connection 88 between the lower end of the reduced neck 64 on elevator space sub 30 and the upper end of inner telescoping tube 62; and a connection 90 between the lower end of inner telescoping tube 62 and the upper end of tubular connector 66*a*.

While it is to be understood that the invention is not limited to the use of any particular type components or to any particular component sizes, examples of some suitable components and sizes are as follows: outer telescoping tube 54 may be of 7⅝" O.D. casing, and inner telescoping tube 62 may be of 4½" O.D. drill pipe. Inner telescoping tube 62 may consist of either one of two or three 30 foot lengths of drill pipe according to whether the amount of extension of the tool between its short or collapsed condition and its long or extended condition is to be, respectively, 30 feet, 60 feet, or 90 feet. The outer telescoping tube 54 needs to be approximately one foot longer than the inner telescoping tube 62, and accordingly may be one length of casing approximately 31 feet long for a tool that is extensible 30 feet, with an additional 30 foot length of casing if the tool is to be extensible 60 feet, and two additional 30 foot lengths of casing if the tool is to be extensible 90 feet.

In a typical operation involving use of a telescoping joint tool 10 according to the invention, the following steps are performed: (1) The telescoping joint 10 is made up in its short or collapsed condition as illustrated in FIG. 5, the swivel 32 is made up into the space sub 30, and the kelly hose is made up. (2) The survey or steering tool 22 and its attached wireline 24 are stripped through wireline packoff 38 into telescoping joint 10, and the telescoping joint with the attached swivel, wireline packoff and kelly hose, and with survey tool 22 therein, is set back in the derrick. (3) The mud motor drill 16 and drill string 12 are tripped into well bore 15. (4) The telescoping joint 10 is then made up into the top joint of drill pipe in the drill string 12 by connecting crossover sub 60 of telescoping joint 10 to the top joint of drill pipe. (5) The survey tool 22 and wireline 24 are run down through the drill string 12 and the survey tool 22 is oriented in the muleshoe orienting sub 20 by means of muleshoe 26 and muleshoe key 28. The apparatus is now in the operative condition illustrated in FIGS. 1, 2, 3 and 5. (6) The first half of a drilling sequence is now performed, typically for 90 feet where 90 foot stands of drill pipe are employed, and during drilling the surface readout 48 is employed to monitor azimuth and drift angle of mud motor drill 16. Azimuth correction can be accomplished by rotation of the rotary table 14 which may be engaged for such purpose by slips to the outside of telescoping joint 10. During this first half of a drilling sequence the telescoping joint 10 will be lowering into the well bore 15.

At the end of this first half of a drilling sequence, typical operation continues as follows: (7) A set of slips is put on the outer tube 54 of telescoping joint 10 proximate its upper end, and tool joint 58 on elevator space sub 30 is backed off from tool joint 78 in drive bushing 56 by suitable tongs (not shown), and inner telescoping structure 52 is elevated to its full extension, typically an extension of 90 feet. (8) Left-hand tool joint 82 on tubular connector 66 or 66*a* is then made up into left-hand tool joint 80 in drive bushing 56. (9) If wireline 24 and survey tool 22 were raised during the elevation of inner telescoping structure 52, then they are lowered, typically 90 feet, until survey tool 22 is re-oriented and keyed into position as shown in FIG. 2, and then the second half of the drilling sequence is performed, typically for another 90 feet. (10) After the full drilling sequence has been completed, typically for 180 feet, a set of slips is engaged with the space sub 30 and the elevators disconnected from space sub 30, and then the wireline 24 and survey tool 22 are tripped upwardly into the upper or extended inner telescoping structure 52 of telescoping joint 10, the elevators are then reconnected to the space sub 30 and the whole string including the extended telescoping joint 10 is raised, typically 90 feet, and a set of slips is engaged with the upper end portion of outer telescoping tube 54 of tool 10. (11) The telescoping joint 10 is then collapsed by first backing off the tool joint 82 on tubular connector 66 or 66*a* from tool joint 80 in drive bushing 56, lowering inner telescoping structure 52 down into outer telescoping structure 50, and making up tool joint 58 on elevator space sub 30 into tool joint 78 in drive bushing 56; and then the whole string is again lifted until the telescoping joint 10 is outside of the well bore 15, a set of slips is engaged with the upper end portion of drill string 12, the short or collapsed telescoping joint 10 is disconnected from the drill string 12 by backing off crossover sub 60 from the top joint of drill pipe in the string, and the telescoping joint 10 with the survey tool 22 therein is set back in the derrick. (12) Two stands of drill pipe, typically totaling 180 feet in length, are then added to the drill string 12 and lowered into well bore 15, and then the entire sequence of steps starting with step (4), making up the telescoping joint 10 into the top joint of newly added drill pipe, is repeated until the desired angle and direction of the curved portion 19 of well bore 15 has been achieved.

Although the presently preferred form of the invention has the inner telescoping structure 52 fixed to the elevator space sub 30 and the outer telescoping structure 50 fixed to the crossover sub 60, it is to be understood that the telescoping joint 10 may alternatively be inverted and suitable tool joints provided on the ends thereof adapting the outer telescoping structure 50 to be fixed to an elevator space sub at the top and the inner telescoping structure to be fixed to a crossover sub at the bottom, within the scope of the invention.

While the invention has been particularly shown and described with reference to a preferred embodiment thereof, it will be understood by those skilled in the art that various changes in form and details may be made therein without departing from the spirit and scope of the invention.

I claim:

1. A method for reducing the number of times for a given footage of well drilled that downhole sensing instrument wireline must be tripped through the drill string for adding more drill pipe, which comprises the steps of:

telescopically extending a tubular telescoping joint that is coaxially connected in the drill string from a collapsed condition to an extended condition; and then drilling a second amount of well bore with the telescoping joint in said extended condition;

said method further comprising releasably axially securing telescoping portions of said joint together in each of said collapsed and extended conditions, said telescoping portions being releasably axially secured together in said collapsed condition by engaging first threaded tool joint means and in said extended condition by engaging second threaded tool joint means.

2. The method recited in claim 1, wherein said releasable axial securing of said telescoping portions in one of said conditions is by engaging right-hand tool joint means and in the other said condition by engaging left-hand tool joint means.

3. The method recited in claim 1, wherein said releasable axial securing of said telescoping portions in said collapsed condition is by engaging right-hand tool joint means and in said extended condition is by engaging left-hand tool joint means.

4. In drilling apparatus comprising a drill string, drilling means at the bottom of the string, and downhole sensing instrument means connected to surface readout means by a wireline extending through the drill string, means for reducing the number of times for a given footage of well drilled that said wireline must be tripped through the drill string for adding more drill pipe, which comprises:

a tubular telescoping joint coaxially connected in said drill string and through which said wireline extends;

said joint comprising a pair of coaxially arranged telescoping portions that are adjustable between a collapsed condition for drilling a first amount of well bore and an extended condition for drilling a second amount of well bore, said telescoping portions comprising first connection means releasably engageable between said telescoping portions for releasably axially securing said portions in said collapsed condition, and second connection means releasably engageable between said telescoping portions for releasably securing said portions in said extended condition, said first and second connection means comprising respective first and second threaded tool joint means.

5. Apparatus as defined in claim 4, wherein one of said connection means comprises right-hand tool joint means and the other said connection means comprises left-hand tool joint means.

6. Apparatus as defined in claim 4, wherein said first connection means comprises right-hand tool joint means and said second connection means comprises left-hand tool joint means.

7. Apparatus as defined in claim 4, wherein said telescoping portions comprise inner and outer telescoping structures, said first tool joint means comprising a first external thread section on said inner structure and a first internal thread section on said outer structure, and said second tool joint means comprising a second external thread section on said inner structure and a second internal thread section on said outer structure.

8. Apparatus as defined in claim 7, wherein said threaded sections on one of said structures are located proximate the same end of such one structure, and said threaded sections on the other said structure are located proximate opposite ends of such other structure.

9. Apparatus as defined in claim 7, wherein said threaded sections on said outer telescoping structure are located proximate the same end of said outer structure, and said threaded sections on said inner telescoping structure are located proximate opposite ends of said inner structure.

10. A method for reducing the number of times for a given footage of well drilled that downhole sensing instrument wireline must be tripped through the drill string for adding more drill pipe, which comprises the steps of:

tripping said wireline down through the drill string;

drilling a first amount of well bore;

telescopically extending a tubular telescoping joint that is coaxially connected in the drill string from a collapsed condition to an extended condition without tripping said wireline up out of the drill string; and then drilling a second amount of well bore with the telescoping joint in said extended condition;

said method further comprising releasably axially securing telescoping portions of said joint together in each of said collapsed and extended conditions, said telescoping portions being releasably axially secured together in said collapsed condition by engaging first threaded tool joint means and in said extended condition by engaging second threaded tool joint means.

11. The method recited in claim 10, wherein said releasable axial securing of said telescoping portions in one of said conditions is by engaging right-hand tool joint means and in the other said condition by engaging left-hand tool joint means.

12. The method recited in claim 10, wherein said releasable axial securing of said telescoping portions in said collapsed condition is by engaging right-hand tool joint means and in said extended condition is by engaging left-hand tool joint means.

13. In drilling apparatus comprising a drill string, drilling means at the bottom of the string, and downhole sensing instrument means connected to surface readout means by a wireline extending through the drill string, means for reducing the number of times for a given footage of well drilled that said wireline must be tripped through the drill string for adding more drill pipe, which comprises:

a tubular telescoping joint coaxially connected in said drill string proximate the top of the drill string and through which said wireline extends;

said joint comprising a pair of coaxially arranged inner and outer telescoping tubular structures that are adjustable between a collapsed condition for drilling a first amount of well bore and an extended condition for drilling a second amount of well bore, right-hand threaded tool joint means releasably engageable between said telescoping tubular structures for releasably axially securing said structures in said collapsed condition, and left-hand threaded tool joint means releasably engageable between said telescoping tubular structures for releasably axially securing said structures in said extended condition;

said right-hand threaded tool joint means comprising an external thread section on said inner structure proximate the upper end of said inner structure, and an internal thread section on said outer structure proximate the upper end of said outer structure;

said left-hand threaded tool joint means comprising an external thread section on said inner structure proximate the lower end of said inner structure, and an internal thread section on said outer structure proximate the upper end of said outer structure but located below the other said internal thread section.

* * * * *